United States Patent [19]

Garrett et al.

[11] Patent Number: 4,979,409

[45] Date of Patent: Dec. 25, 1990

[54] CLUTCH ADJUSTING TOOL

[76] Inventors: Junior G. Garrett; Robert L. Meadows, both of 5710 Kermit Ave., Odessa, Tex. 79760

[21] Appl. No.: 478,397

[22] Filed: Feb. 12, 1990

[51] Int. Cl.[5] ..... B25B 25/00

[52] U.S. Cl. ..... 81/484; 81/486

[58] Field of Search ..... 81/484, 486, 488; 29/240

[56] References Cited

U.S. PATENT DOCUMENTS

| | | | |
|---|---|---|---|
| 2,810,314 | 10/1957 | Strong | 81/486 |
| 3,340,752 | 9/1967 | Carney et al. | 81/484 |
| 4,535,655 | 8/1985 | Avery | 81/484 |
| 4,756,215 | 7/1988 | Darnell | 29/240 |

*Primary Examiner*—Roscoe V. Parker

*Attorney, Agent, or Firm*—Marcus L. Bates

[57] ABSTRACT

An adjusting tool by which the adjusting ring of a clutch assembly can be rotated respective to the clutch cover. The tool is attached to the clutch cover at the access hole. Part of the tool engages the circumferentially extending spaced lugs formed near the outer periphery of the adjusting ring. The tool has gear teeth of a configuration to mesh with the spaced lugs on the ring and to drivingly engage and rotate the ring when the shaft is rotated about the longitudinal axis thereof. A mounting fixture is removably attached the cover access hole with the drive gear device extending into the access hole and into engagement with the lugs of the ring so that the wrench engaging means can be engaged with a suitable wrench and the ring rotated respective to the housing to thereby adjust the spring tension on the clutch assembly.

15 Claims, 2 Drawing Sheets

CLUTCH ADJUSTING TOOL

BACKGROUND OF THE INVENTION

There are clutch assemblies built for internal combustion engines that require adjustment from time to time by rotating a threaded adjustment ring. The adjustment ring moves axially as it is rotated, and is arranged to vary the tension on the clutch springs thereof according to the position of the ring respective to the clutch housing. An example is a Spicer stamped angle spring clutch assembly. The ring has a threaded surface on the outermost circumferential edge portion thereof that threadedly engages the clutch housing, and a circle of spaced lugs thereon that can be engaged with a lever and moved one lug at a time to rotate the ring.

The clutch housing is bolted to and rotates with the crankshaft of the engine. The clutch housing usually is enclosed within a bell housing that supports the transmission from the engine block. Accordingly, in order to adjust the clutch, one must gain access into the interior of the bell housing and thereafter gain access to the adjusting ring contained within the clutch housing. It is not too difficult for an experienced mechanic to gain access to the lugs on the adjustment ring; however, it is a laborious task to rotate the ring by engaging and moving one lug at a time, and continuing in this manner until the adjusting ring has rotated one or more complete revolutions.

In the past, a number of different prior art tools have been employed for engaging and rotating the ring. Many of the tools, such as brake adjusting tools and screw drivers, are not made specifically for adjusting the clutch ring. Adjusting the clutch is therefore a laborious task because a lot of manipulations are required in order to rotate the ring one revolution respective to the clutch housing. It would therefore be desirable to be able to engage and rotate the adjusting ring of an angle spring clutch assembly in a less laborious and more time saving manner. A clutch adjusting tool which overcomes the above problems and provides many beneficial results is the subject of the present invention.

SUMMARY OF THE INVENTION

This invention comprehends a clutch adjusting tool device having a rotatable gear thereon for engaging and rotating an adjustment ring associated with a prior art clutch assembly.

More specifically, the tool of the present invention comprises an assembly that includes a mounting fixture for attachment to a clutch housing, and a drive gear rotatably received by the mounting fixture that meshes with spaced lugs of the clutch adjustment ring so that rotation of the drive gear imparts rotation into the adjustment ring.

The present invention can be used in combination with an angle spring clutch assembly of the type having a clutch housing within which there is threadedly attached an adjusting ring. Rotation of the ring about its central axis adjusts the spring tension exerted on the clutch thereof. The adjustment ring is of the type having circumferentially extending spaced lugs near the outer periphery thereof which can be engaged by the clutch adjusting tool of the present invention. The tool inlcudes a mounting fixture and a drive gear device. An existing access hole already provided in the clutch housing is used to removably receive the mounting fixture of the tool thereon, while the drive gear device of the tool is supported by the fixture and extends into engagement with the lugs on the clutch adjustment ring. The drive gear is engaged and rotated by any suitable prior art lever or cranking means in order to rotate the shaft thereof and drive the ring in a clockwise or counterclockwise direction in order to increase or decrease the spring tension of the clutch assembly.

A primary object of the present invention is the provision of an adjusting tool device in combination with a prior art clutch assembly, wherein the tool has a gear thereon that meshes with part of an adjustment ring of the clutch and rotates the ring to thereby enable adjustment of the clutch to be achieved in a new and unobvious manner.

Another object of this invention is the provision of an improved tool apparatus for use in adjusting a clutch assembly of the type having an adjustment ring. The tool engages the ring in a manner whereby rotation of the tool rotates the adjusting ring and enables the clutch spring tension to be adjusted.

A still further object of this invention is the provision of a tool comprising a mounting fixture for attachment to a clutch housing and a drive gear device rotatably supported by the fixture for engaging and rotating an adjustment ring associated with the clutch assembly.

These and various other objects and advantages of the invention will become readily apparent to those skilled in the art upon reading the following detailed description and claims and by referring to the accompanying drawings.

The above objects are achieved in accordance with the present invention by the provision of a combination of elements fabricated in a manner substantially as described herein and particularly by a tool for adjusting a clutch assembly of the type having a clutch housing within which there is rotatably mounted an adjusting ring which can be rotated about the central axis thereof in order to adjust the spring tension that is exerted on the clutch thereof; there being circumferentially extending spaced lugs formed near the outer periphery of the adjustment ring, an access hole in the housing by which access is gained for engaging the lugs on the ring and to rotate the adjusting ring in order to adjust the tension on the clutch. The tool of this invention comprises a mounting fixture for attachment to the clutch housing and a drive gear device supported by the fixture for engaging the lugs and thereby rotating the ring; the drive gear device has a shaft, and the shaft has opposed ends, with gear teeth at one end of the shaft and wrench engaging means at the other end of the shaft. The gear teeth are of a configuration to mesh with the spaced lugs on the ring and to drivingly engage and rotate the ring when the shaft is rotated about the longitudinal axis thereof.

The mounting fixture has an opening therein for rotatably supporting the drive gear shaft in journaled relationship therein; and means on the mounting fixture for removably attaching the mounting fixture to the clutch housing with the drive gear device extending into the access hole where the gear teeth of the drive gear device are brought into engagement with the lugs of the ring. The wrench engaging means can be engaged with a suitable wrench and is actuated to rotate the drive gear shaft whereupon the ring is rotated respective to the housing to thereby adjust the spring tension of the clutch assembly.

DETAILED DESCRIPTION OF THE PREFERRED EMBODIMENT

Figure 1:
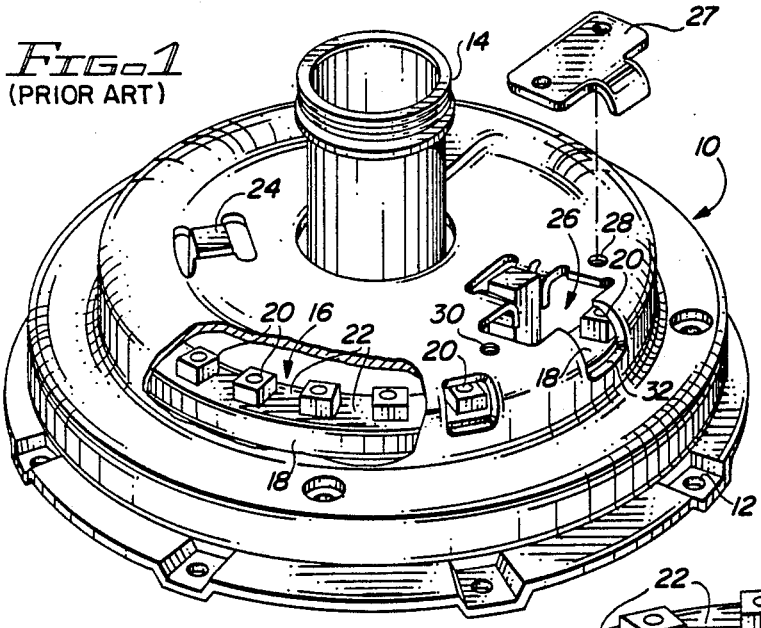
FIG. 1 (PRIOR ART)
FIG. 1 is an isolated, part disassembled view of a prior art clutch assembly, with some parts being removed therefrom and some of the remaining parts being shown in cross-section.

In the prior art illustration of FIG. 1, there is disclosed an angle spring clutch assembly having a cover 10 and a circle of bolt holes 12 therein by which the cover is mounted to a clutch plate (not shown) which in turn mounts to a crankshaft of an engine. A clutch output shaft 14 accommodates the propeller shaft of a transmission in the usual manner. A threaded adjusting ring 16 has an outermost threaded surface 18 that threadedly engages complementary female threads formed on the interior of the stamped metal cover 10. A plurality of circumferentially extending, spaced apart lugs 20 extend rearwardly from attachment to the adjustment ring 16, and flats 22 are formed between the lugs 20. Numeral 24 illustrates an opening that receives a guide part of the clutch assembly. Numeral 26 indicates an access hole which is covered by the illustrated cover plate 27. Numerals 28 and 30 are threaded holes by which bolts located in the apertures of plate 27 are attached to the cover 10. The illustrated inwardly extending tab seen on plate 27 is received within one of the flats 22 in order to secure the ring against rotation respective to cover 10.

FIGS. 2–7 disclose an adjusting tool apparatus 34 made in accordance with the present invention. The adjusting tool apparatus 34 is hereinafter referred to as "tool 34". The tool 34 comprises a mounting fixture 36 which rotatably receives a drive gear device 38 therewithin and which is hereinafter called "drive gear 38".

Figure 2:
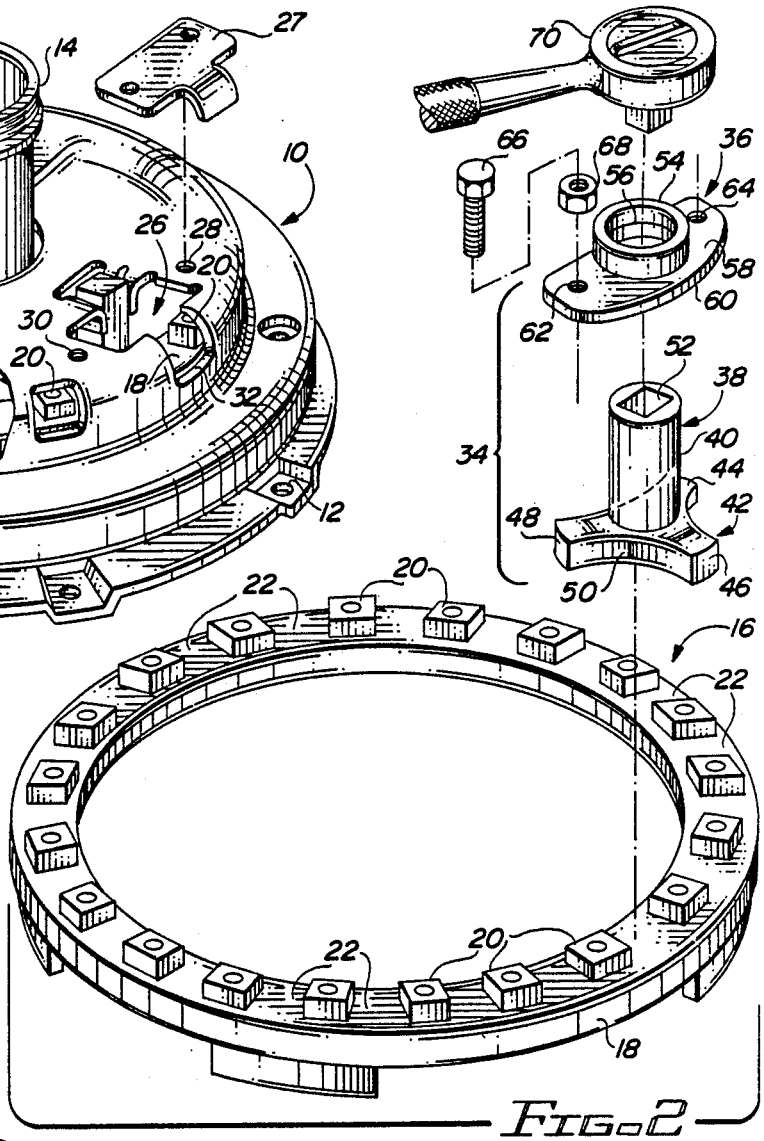
FIG. 2 is a slightly enlarged, perspective, disassembled view showing the combination of the present invention.
Figure 6:
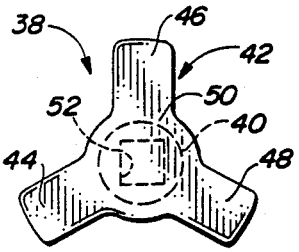
FIG. 6 is a bottom view of a tool made in accordance with the present invention.

As best seen in FIG. 2, together with other figures of the drawings, the drive gear 38 has a shaft 40 arranged perpendicularly respective to a toothed gear 42 formed at one end thereof. The toothed gear includes spaced gear teeth 44, 46 and 48 radially extending from shaft 40 and arranged 120 degrees apart. Each gear tooth 44, 46, and 48 is of a size to be drivingly received within a flat 22 located between adjacent lugs 20 of ring 16. The intervening space between the gear teeth 44, 46, and 48 is of a configuration to receive the lugs 20 therebetween whereby the gear teeth and the lugs inter-engage one another and thereby drivingly accommodate one another somewhat similar to the action of a small prior art gear that meshes with and drives a large gear, for example.

The lower face 50 of the toothed gear 42 of the drive gear 38 is opposed to an outer end having a female socket receiving recess 52 formed therein. The recess 52 is of a configuration to accept a crank or drive wrench of any number of different designs.

The mounting fixture 36 has an upstanding bushing 54 of annular configuration made integral therewith for accommodating a central bore 56 formed perpendicularly through the mounting fixture. The mounting fixture bore 56 is of a size to rotatably receive shaft 40 of drive gear 38 in journaled relationship therewith. The mounting fixture 36 has an upper flat face 58 opposed to a lower flat face 60, and further includes spaced bolt receiving apertures or holes 62, 64 spaced from the bore 56. Numeral 66 indicates bolts of a size to extend through bolt holes 62, 64. Stop nut 68 allows the thread depth extending below face 60 to be easily adjusted. The apertures 28, 30, 56, 62 and 64 are indexed with one another to properly mesh gear 42 with lugs 20 and flats 22. The flat face 58 is of irregular configuration and has a curved outer edge opposed to a curved inner edge part.

Figure 5:
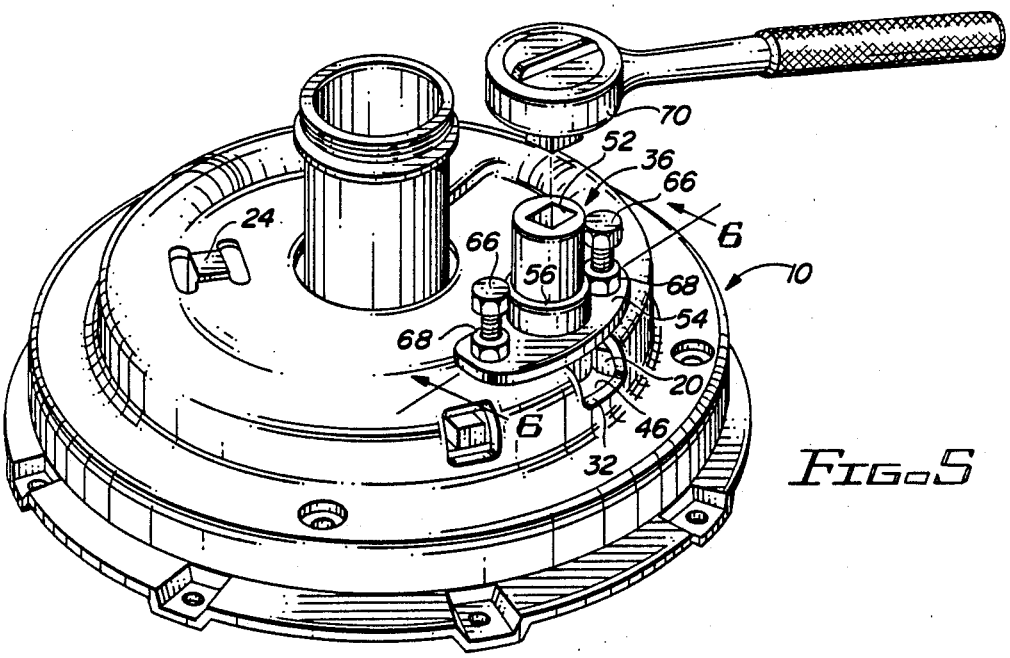
FIG. 5 is a perspective view illustrating a tool made in accordance with the present invention operatively attached to a prior art clutch device.
Figure 7:
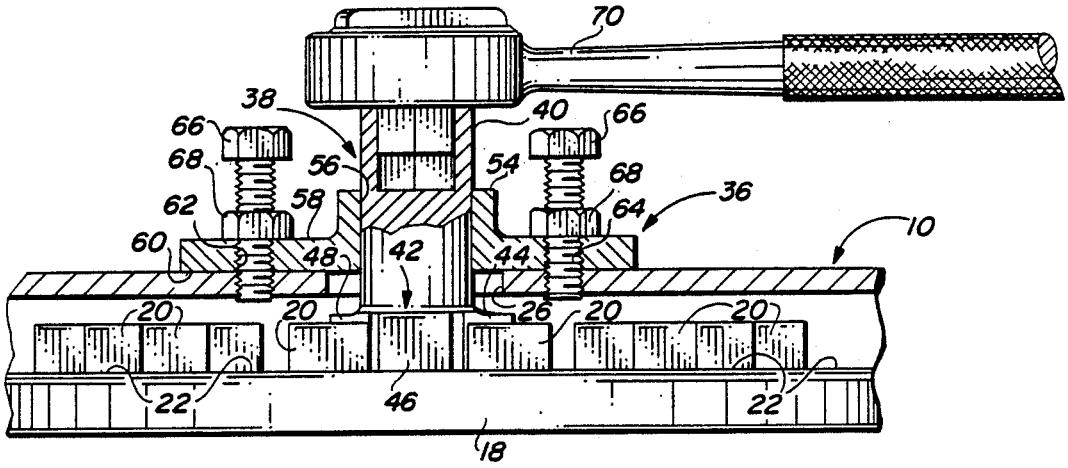
FIG. 7 is a fragmentary, part cross-sectional, side elevational view showing the present invention attached to a prior art clutch assembly.

In FIGS. 2 and 5, numeral 70 indicates an ordinary ratchet wrench having the usual square drive. The square drive is fitted into the drive hole or recess 52 of the drive gear 38. Attached hereto and forming a part of this disclosure is a brochure showing Spicer stamped angle-spring clutches, such as can be adjusted with the tool device of this invention.

Figure 3:
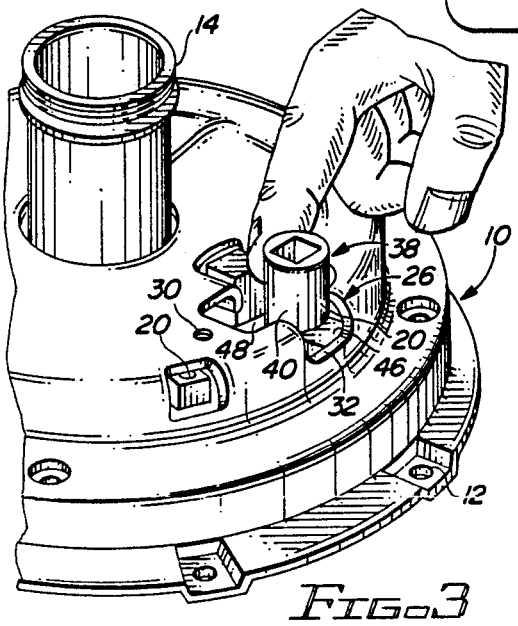
FIG. 3 is a fragmented, partially disassembled, perspective view showing part of the tool of the present invention in operative association with part of the apparatus of FIG. 1.
Figure 4:
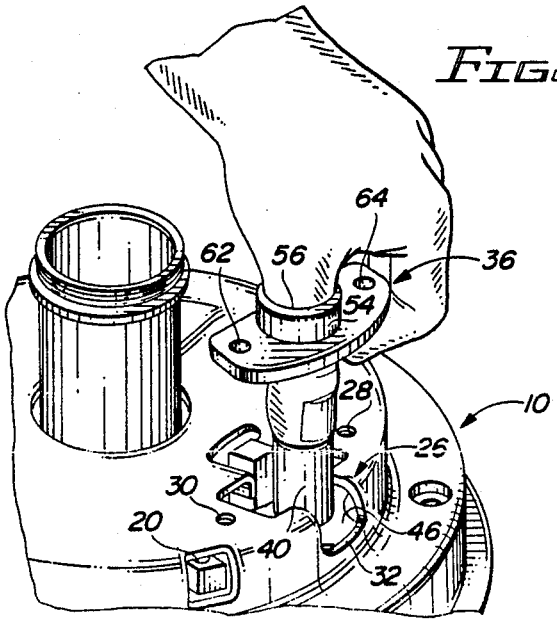
FIG. 4 is a fragmentary, perspective, representation of part of FIG. 1 showing the assembly of the tool, made in accordance with the present invention, in combination with a prior art clutch assembly.

In operation, it will be assumed that a truck having a Spicer type angle spring clutch assembly, as seen in FIG. 1, installed thereon, has become partially inoperative and the prudent driver knows that he must have his clutch adjusted or he will very soon be faced with an expensive repair job. A mechanic, having a tool 34 made in accordance with the present invention, positions himself below the truck's transmission, removes the inspection cover from the transmission bell housing (not shown), thereby gaining access to the clutch cover 10. The two bolts securing cover plate 27 to access hole 26 of the clutch cover are removed and the clutch cover plate 27 is easily lifted or removed from proximity of the access hole. The removal of cover plate 27 unlocks the adjusting ring 16 respective to the clutch cover 10 and exposes the adjusting ring lugs 20 as illustrated in FIGS. 1 and 5. The bolt holes 62, 64 are spaced to register with the threaded bolt holes 28, 30 of the clutch cover. The access hole 26 is of size to accommodate the lower end of toothed gear 42 of the drive gear 38 as illustrated in FIGS. 3–5 of the drawings. The flat 22 between lugs 20 is already aligned with the reduced opening part 32 of the access hole 26 and accordingly, the adjusting tool 34 can be mounted to the ring gear and to the housing by engaging one of the teeth 44, 46 and 48 with the flat 22 that is aligned with the access hole as seen in FIG. 3, and thereafter the fixture 36 is easily placed in operative relationship respective to the drive gear 38 and bolt holes 28, 30; as seen in FIG. 4. Next bolts 66 are threadedly made up with the threaded bolt holes 28, 30 found on opposed sides of the opening 26 formed in the clutch cover 10. Stop nuts 68 are then jammed against the upper face 58 of the mounting fixture 36 to secure the confronting faces of the fixture and clutch cover against one another.

Next, a wrench 70 is fitted to recess 52 in the drive end of mounting fixture 36, with the square drive end 72 of the wrench being inserted into the female co-acting cavity or recess 52 of drive gear 38. The rachet wrench 70 can be actuated to drive threaded adjusting ring 16 exactly like one would drive a nut onto a bolt using a rachet wrench. The ring 16, when screwed toward the motor, increases the spring tension and when screwed away from the motor, reduces the tension on the angle spring clutch assembly.

During this time, the driver can be seated in the cab of the truck, and he can manipulate the clutch from time to time in order to obtain the best clutch travel and feel, and direct the mechanic's work so that the clutch disengages exactly like he desires. As soon as the adjustment has been accomplished, the adjusting tool 34 is removed from access hole 26 and cover plate 27 is placed back over the hole with the tab of the cover extending into a flat 22 and locking the adjusting ring respective to housing 10.

Those skilled in the art, having fully digested this disclosure, will appreciate that the two part tool 34 can be assembled in captured relationship so that the assembly set forth in the illustration of FIGS. 3 and 4 is simplified. Moreover, the configuration of the two parts of the tool can be changed to accommodate other similar type clutches, and into all sorts of variations that achieve the same purpose of this invention, and such modifications are deemed to fall within the meets and bounds of the present invention.

We claim:

1. In a clutch assembly of the type having a clutch housing within which there is rotatably mounted an adjusting ring which can be rotated about the central axis thereof in order to adjust the spring tension that is exerted on the clutch thereof; there being circumferentially extending spaced lugs formed near the outer periphery of the ring, an access hole in the housing by which access is gained for engaging the lugs on the ring and to rotate the adjusting ring in order to adjust the spring tension on the clutch; the combination with said clutch assembly of an adjusting tool apparatus by which the adjusting ring can be rotated respective to the housing;

said tool comprises a mounting fixture for attachment to the housing and a drive gear device supported by the fixture for engaging the lugs and thereby rotating the ring;

said drive gear device has a shaft, said shaft has opposed ends, gear teeth at one end of said shaft, wrench engaging means at the other end of said shaft, said gear teeth are of a configuration to mesh with the spaced lugs on the ring and to drivingly engage and rotate the ring when said shaft is rotated about the longitudinal axis thereof;

said mounting fixture has an opening therein for rotatably supporting the drive gear shaft in journaled relationship therein; means on said mounting fixture for removably attaching said mounting fixture to the clutch housing with the drive gear device extending into the access hole where the gear teeth of the drive gear device are brought into engagement with the lugs of the ring, whereby: said wrench engaging means can be engaged with a suitable wrench which is actuated to rotate the drive gear shaft whereupon the ring is rotated respective to the housing to thereby adjust the spring tension of the clutch assembly.

2. The combination of claim 1 wherein there are three said gear teeth radiating from said shaft and arranged 120 degrees apart.

3. The combination of claim 1, wherein said mounting fixture has a base; a bushing supported by said base for receiving said shaft in journaled relationship therein; apertures in said base that are spaced from said bushing and from one another whereby the last said apertures register with any holes that may be associated with the access hole cover attachment means.

4. A tool apparatus for adjusting a clutch assembly of the type having a clutch within a cover, the cover being threadedly attached to an adjusting ring which is rotated about its axis in order to move the ring axially and thereby adjust the spring tension that is exerted on the clutch thereof; there being circumferentially extending spaced lugs formed near the outer periphery of the ring, an access hole in the cover by which access is gained to the interior thereof for engaging the lugs on the ring and to rotate the adjusting ring in order to adjust the spring tension on the clutch;

said tool apparatus comprises a mounting fixture for attachment to the cover and a drive gear device supported by the fixture at a location that engages the drive gear device with the lugs for rotating the ring;

said drive gear device has a drive shaft, said drive shaft has opposed ends, gear teeth at one end of said drive shaft, wrench engaging means at the other end of the drive shaft, said gear teeth are of a configuration to mesh with the spaced lugs on the ring and to drivingly engage and rotate the ring when said shaft is rotated about the longitudinal axis thereof;

means on said mounting fixture for rotatably supporting said drive shaft; means on said mounting fixture for removably attaching said mounting fixture to the cover with the drive gear device extending into the access hole and into engagement with the lugs of the ring whereby said wrench engaging means can be engaged with a suitable wrench and the ring rotated respective to the cover and thereby adjust the spring tension on the clutch assembly.

5. The tool of claim 4, wherein there are three said gear teeth radiating from said shaft and arranged 120 degrees apart.

6. The tool of claim 4, wherein the cover has an access hole and an access hole cover with attachment means; said means on said mounting fixture is a bushing, said fixture has a base; apertures in said base that are spaced from said bushing and from one another whereby the last said apertures register with the access hole cover attachment means, whereby, a fastener means received through the apertures of the base and the access hole cover attachment means releasably mounts the tool apparatus to the cover.

7. The adjusting tool of claim 4, wherein said mounting fixture has a bushing formed thereon for rotatably supporting the drive gear shaft in journaled relationship therein; means on said mounting fixture for removably attaching said mounting fixture to the housing with the drive gear device extending into the access hole and into engagement with the lugs of the ring whereby said wrench engaging means can be engaged with a suitable wrench and the ring rotated respective to the housing to thereby adjust the spring tension on the clutch assembly.

8. In a clutch assembly of the type having a clutch cover within which there is threadedly attached an adjusting ring which, when rotated about its axis, moves axially and adjusts the spring tension that is exerted on the clutch thereof; there being circumferentially extending spaced lugs formed on the ring, an access hole in the clutch cover by which access may be gained for engaging the lugs on the ring to rotate the adjusting ring in order to adjust the spring tension on the clutch; the improvement comprising:

a clutch adjusting tool apparatus by which the ring can be engaged and rotated respective to the clutch cover;

said tool apparatus comprises a mounting fixture by which the adjusting tool apparatus can be releasably attached to the clutch cover, said tool apparatus includes a drive gear device supported by said mounting fixture for engaging the lugs and rotating the adjusting ring;

said drive gear device has a drive shaft; said drive shaft has opposed ends, gear teeth mounted at one end of said shaft, wrench engaging means formed at the other end of said shaft, said gear teeth are of a configuration to mesh with the spaced lugs on the ring and to drivingly engage the lugs and thereby rotate the ring when said drive shaft is rotated about the longitudinal axis thereof and thereby adjust the clutch.

9. The improvement tool of claim 8 wherein said mounting fixture has a bushing for rotatably supporting the drive gear shaft in journaled relationship therein; means on said mounting fixture for removably attaching said mounting fixture to the housing with the drive gear device extending into the access hole and into engagement with the lugs of the ring whereby said wrench engaging means can be engaged with a suitable wrench and the ring rotated respective to the housing to thereby adjust the spring tension on the clutch assembly.

10. The improvement of claim 9 wherein there are three said gear teeth radiating from said shaft and arranged 120 degrees apart.

11. The improvement of claim 8 wherein said mounting fixture has a base; apertures in said base that are spaced from said bushing and from one another whereby the last said apertures register with the access hole cover attachment means.

12. The improvement of claim 11, wherein there are three said gear teeth radiating from said shaft and arranged 120 degrees apart.

13. The adjusting tool of claim 8 wherein said mounting fixture has a bushing for rotatably supporting the drive gear shaft in journaled relationship therein; means on said mounting fixture for removably attaching said mounting fixture to the housing with the drive gear device extending into the access hole and into engagement with the lugs of the ring whereby said wrench engaging means can be engaged with a suitable wrench and the ring rotated respective to the housing to thereby adjust the spring tension on the clutch assembly;

there are three said gear teeth radiating from said shaft and arranged 120 degrees apart;

said mounting fixture has a base; apertures in said base that are spaced from said bushing and from one another whereby the last said apertures register with the access hole cover attachment means.

14. The tool of claim 8, wherein there are three said gear teeth radiating from said shaft and arranged 120 degrees apart; said mounting fixture has a base; apertures in said base that are spaced from said bushing and from one another whereby the last said apertures register with the access hole cover attachment means.

15. The adjusting tool of claim 14 wherein said mounting fixture has a bushing for rotatably supporting the drive gear shaft in journaled relationship therein; means on said mounting fixture for removably attaching said mounting fixture to the housing with the drive gear device extending into the access hole and into engagement with the lugs of the ring whereby said wrench engaging means can be engaged with a suitable wrench and the ring rotated respective to the housing to thereby adjust the spring tension on the clutch assembly.

* * * * *

UNITED STATES PATENT AND TRADEMARK OFFICE

CERTIFICATE OF CORRECTION

PATENT NO. : 4,979,409

DATED : December 25, 1990

INVENTOR(S) : Junior G. Garrett and Robert L. Meadows

It is certified that error appears in the above-identified patent and that said Letters Patent is hereby corrected as shown below:

Column 5, lines 28, 63, and 66, insert --adjusting before --ring--;
line 45, insert --adjusting-- brfore "tool" and --apparatus-- after "tool";
line 48, insert --adjusting-- before "ring";
line 53, insert --adjusting-- before "ring";
line 54, insert --adjusting-- before "ring".

Signed and Sealed this

Thirtieth Day of November, 1993

Bruce Lehman

*Attest:*

BRUCE LEHMAN

*Attesting Officer*

*Commissioner of Patents and Trademarks*